US007766598B2

(12) United States Patent
Gotoh et al.

(10) Patent No.: US 7,766,598 B2
(45) Date of Patent: Aug. 3, 2010

(54) BUNDLE TRANSPORT APPARATUS FOR PAPER SHEET MATERIALS AND HANDLING APPARATUS FOR THE SAME

(75) Inventors: Yasushi Gotoh, Inagi (JP); Kazuto Kitano, Inagi (JP); Hayato Minamishin, Inagi (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/519,821

(22) Filed: Sep. 13, 2006

(65) Prior Publication Data

US 2007/0007712 A1 Jan. 11, 2007

Related U.S. Application Data

(63) Continuation of application No. PCT/JP2004/017715, filed on Nov. 29, 2004.

(30) Foreign Application Priority Data

Mar. 15, 2004 (JP) ..... 2004-073610

(51) Int. Cl.
*B65H 1/08* (2006.01)

(52) U.S. Cl. ..... 414/787

(58) Field of Classification Search ..... 414/293, 414/331.11, 593, 787, 749.6; 74/837, 22 A, 74/27, 436–438
See application file for complete search history.

(56) References Cited

U.S. PATENT DOCUMENTS 2,030,816 A * 2/1936 Fenton ..... 198/456
3,708,074 A * 1/1973 Fahey et al. ..... 211/151
3,902,589 A * 9/1975 Bylsma ..... 198/790
4,151,754 A 5/1979 Reist ..... 74/89.2
4,355,715 A * 10/1982 Chorlton ..... 198/781.02
4,750,605 A * 6/1988 Brems et al. ..... 198/468.8
5,096,367 A * 3/1992 Winski ..... 414/801
5,205,703 A * 4/1993 Shill et al. ..... 414/796

(Continued)

FOREIGN PATENT DOCUMENTS

DE 40 09 139 C1 9/1991

(Continued)

OTHER PUBLICATIONS

Supplementary European Search Report dated Dec. 6, 2007.

*Primary Examiner*—Charles A Fox
(74) *Attorney, Agent, or Firm*—Kratz, Quintos & Hanson, LLP

(57) ABSTRACT

The configuration comprises a carrier equipping an ejection plate on the front for ejecting the bundled-paper sheet material P and equipping a plurality of cutout parts, which are open in their top parts, at a predetermined interval on both the left and right sides; and a drive transmission unit being equipped by a plurality of drive rollers, each of which comprises a plurality of bosses in a predetermined interval on a single circumference around the rotation center thereof, in a predetermined interval on both the left and right sides of the bundled-paper sheet material transport path, wherein a drive force is transmitted by allowing bosses of each drive roller, which rotates by receiving a drive force from a drive source, engage in the respective cutout parts of the carrier sequentially, thereby allowing the carrier travel in the front and back directions of the bundle transport path.

6 Claims, 6 Drawing Sheets

U.S. PATENT DOCUMENTS

| | | | | |
|---|---|---|---|---|
| 5,634,760 | A * | 6/1997 | Anderson et al. | 414/268 |
| 5,878,016 | A * | 3/1999 | Kubokawa et al. | 369/30.95 |
| 6,450,319 | B1 | 9/2002 | Reist | 198/358 |
| 6,644,459 | B2 * | 11/2003 | van Leeuwen et al. | 198/370.1 |
| 7,246,363 | B2 * | 7/2007 | Morioka et al. | 720/614 |
| 7,306,091 | B2 * | 12/2007 | Eubanks et al. | 198/787 |

FOREIGN PATENT DOCUMENTS

| | | |
|---|---|---|
| JP | 64-53958 | 3/1989 |
| JP | 9-56119 | 2/1997 |
| JP | 11-278665 | 10/1999 |
| JP | 2001-14511 | 1/2001 |
| JP | 2001-190819 | 7/2001 |

* cited by examiner

BUNDLE TRANSPORT APPARATUS FOR PAPER SHEET MATERIALS AND HANDLING APPARATUS FOR THE SAME

CROSS-REFERENCE TO RELATED APPLICATIONS

This application is a continuation of International Application No. PCT/JP2004/017715, which was filed on Nov. 29, 2004.

BACKGROUND OF THE INVENTION

1. Field of the Invention

The present invention relates to a bundled-paper sheet material transport apparatus for transporting paper sheet materials, such as bundled bank notes, to a handling apparatus for paper sheet materials, such as an ATM (automated teller machine), and in particular to a bundled-paper sheet material transport apparatus and a handling apparatus, for paper sheet materials that is capable of accomplishing a stable bundled-paper sheet material transportation by firmly preventing a malfunction, retaining a wide range of versatility without being influenced by other transport mechanisms and reducing components and an installation space.

2. Description of the Related Art

Conventionally, utilization of a belt transport mechanism has been the common means for transporting paper sheet materials in a bundle, i.e., a state of vertically accumulating them. For example, it has been configured to apply tension to flat belts made of an elastomer, et cetera, installed cross-wise in the transport path, and to transport a bundled-paper sheet materials by pressing the flat belt thereon, as disclosed by laid-open Japanese patent application publications No. 2001-14511 and No. 11-278665.

Although the above noted conventional belt transport mechanism is effective in the case of a high speed transportation of a sheet material sheet by sheet, the case of transporting a bundled-paper sheet material s for a long distance is problematic because of the breaking down of the bundled state during the transportation. In order to eliminate such a problem, it is necessary to install many components such as rollers, shafts, et cetera, for providing tension to respective components in places relating to the transportation direction of the sheet materials in an intermediate part of the flat belts, therefore making the configuration complex due to an increased number of components and making it difficult to secure installation spaces thereof.

Since the above described belt transport mechanism is configured so that a series of flat belts traverse across the transport path, other problems occur when a cross-wise installation of tracks is replaced with another belt transport mechanism in order to lift a bundle of paper sheet materials, for example.

Accordingly, to the transport mechanism may be equipped by means other than the belt transport mechanism, such as drive transmission units made up of a rack and a pinion on both of the right and left sides of a transport path for a bundle of sheet materials, wherein the bundle is transported by making the drive transmission units run an ejection body along the bundle transport path. However, such a configuration may have problems of a displaced meshing of the left and right side gear pairs due to a backlash caused by a mutual phase difference between the respective pairs of rack and pinion on the left and right sides, therefore resulting in requiring high precision in the gear forms and the synchronization thereof.

[Patent document 1] laid-open Japanese patent application publication No. 2001-14511

[Patent document 2] laid-open Japanese patent application publication No. 11-278665

SUMMARY OF THE INVENTION

In consideration of the above noted problems, the purpose of the present invention is to provide a bundle transport apparatus for paper sheet materials capable of accomplishing a stable bundle transportation by firmly preventing a malfunction, retaining a wide range of versatility without being influenced by other transport mechanisms and reducing components and installation space.

In order to achieve the above noted purpose, a bundled-paper sheet material transport apparatus according to the present invention comprises a carrier capable of traveling back and forth on a bundled-paper sheet material transport path equipped with an ejection plate on the front for ejecting the bundled-paper sheet material and equipping a plurality of cutout parts that are open in their top parts at predetermined intervals on both the left and right sides; and a drive transmission unit being equipped by a plurality of drive rollers, each of which comprises a plurality of bosses in predetermined intervals on a single circumference around the rotation center thereof, in a predetermined interval on both the left and right sides of the bundled-paper sheet material transport path, wherein a drive force is transmitted by allowing the bosses of each drive roller, which rotate by receiving a drive force from a drive source, engage in the respective cutout parts of the carrier sequentially, thereby allowing the carrier travel in the front and back directions of the bundled-paper sheet material transport.

A preferred comprisal is achieved by configuring each cutout part of the carrier as a rectangular shape with its top part open and allowing a gap between the boss and the cutout part by configuring each of the bosses, which are equipped with each drive roller of the drive transmission unit, to be column shaped, and making the width of each cutout part larger than the diameter of the boss.

A preferred comprisal is achieved by equipping a pulley for each drive roller of the drive transmission unit and connecting the respective pulleys of the adjacent drive rollers with separate timing belts, thereby connecting all or a part of the drive rollers.

A preferred comprisal is achieved by equipping, on an ejection plate of the carrier, one or more upright tabs projecting toward a top wall and/or a floor wall of the bundle transport, and featuring, on the top wall and/or a floor wall of the bundle transport and extending in the front and back direction thereof, an accommodating groove for the upright tab.

Furthermore, in order to achieve the above noted purpose, a paper sheet material handling apparatus according to the present invention comprises a bundled-paper sheet material transport apparatus according to the above description and, in addition includes an elevator member capable of moving up and down while retaining paper sheet materials in a bundled state, wherein a handover of the paper sheet materials mutually between the elevator member and a carrier of the bundle transport apparatus is enabled by making the elevation track of the elevator member cross with the travel track of the carrier of the bundle transport apparatus.

The bundle transport apparatus and the handling apparatus for paper sheet materials make it possible to have a carrier travel in the front and back directions by allowing the bosses of each drive roller engage in the respective cutouts of the carrier sequentially, thereby allowing the bosses to engage in their respective cutout parts firmly by allowing for play between each cutout and the boss and absorbing a phase difference by using the play if a phase difference of rotations of each roller on the left and right sides exists, thereby firmly preventing a malfunction of the apparatus and accomplishing a stable bundle transport.

Also, since the configuration allows the carrier, which is free in the front and back directions on the another bundle transport, to travel by transmitting a drive force on each drive roller, there is no need to have a flat belt traverse across the bundle transport path as in the case of conventional belt transport mechanisms. Hence, making it possible to equip another transport mechanism, such as a belt, cross-wise in the bundle transport path that is along the travel track of the carrier. That is, the bundled-paper sheet material transport apparatus according to the present invention has a wide rang of versatility without being influenced by another transport mechanism.

Furthermore, in the case of connecting all, or a part of, the respective drive rollers by interconnecting the respective pulleys of the adjacent drive rollers with separate timing belts, it is possible to transport with a stable drive force if the bundle transport is long, and it eliminates a need for equipping a large number of components, such as a roller, shaft, et cetera, in order to provide the flat belt with a tension as in the case of the above noted conventional belt transport mechanism, hence reducing the required components and installation space as compared to the conventional system.

Additionally to the above described benefits, in the case of equipping an upright tab on the ejection plate of the carrier and forming an accommodating groove for the upright tab on the top wall and/or floor wall of the bundle transport, it is possible to prevent a paper sheet material from going into the gap between the ejection plate and the top and/or floor wall of the bundle transport, thereby preventing a malfunction, such as a paper jam, and contributing to a stable bundle transport.

Another preferred comprisal is achieved by bending back an upper and/or lower part of the ejection plate toward the back direction, thereby making the upper and/or lower edges thereof a circular arc surface, and positively forming a predetermined gap between the upper and/or lower edges of the ejection plate and the top and/or floor walls of the bundle transport path. This configuration, together with the above described upright tab, makes it possible to prevent a paper sheet material from being hitched by the upper and/or lower edges of the ejection plate, thus contributing to a more stable bundle transport by firmly preventing a malfunction such as a paper jam.

DESCRIPTION OF THE PREFERRED EMBODIMENT

The following description is of a bundle transport apparatus and a handling apparatus for paper sheet materials according to an embodiment of the present invention referring to FIGS. 1 through 6. Here, the present embodiment is configured to carry a bundle transport for banknotes as a paper sheet material by equipping a bundle transport apparatus in a part of a banknote receipt and payout apparatus (i.e., a paper sheet material handling apparatus) such as an ATM (automated teller machine) as an example.

Figure 1:
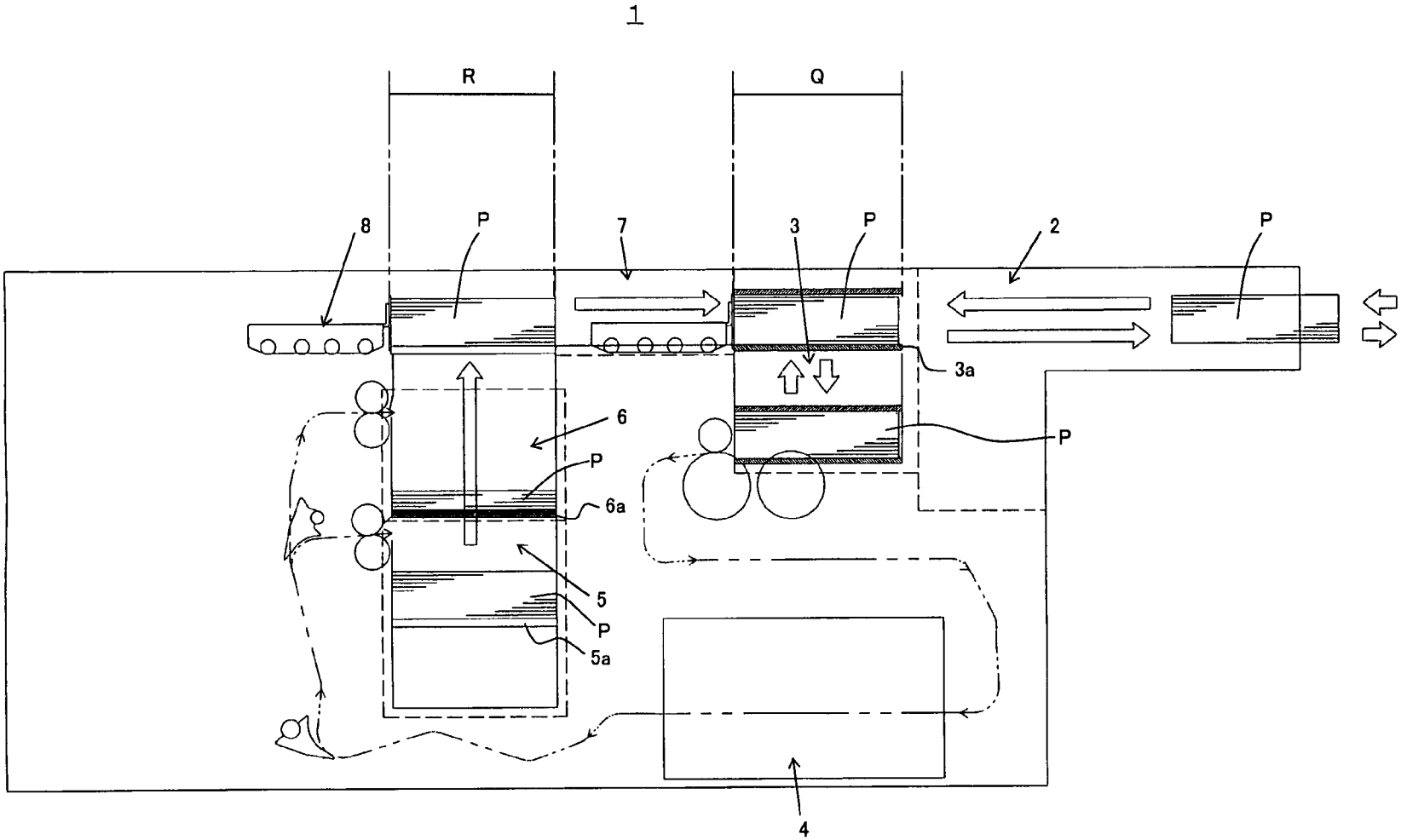
FIG. 1 is an illustration of a paper sheet material handling apparatus (i.e., a banknote receipt and payout apparatus) according to an embodiment of the present invention, and a bundled paper sheet material transport apparatus constituting a part thereof according to an embodiment of the present invention.
Figure 2:
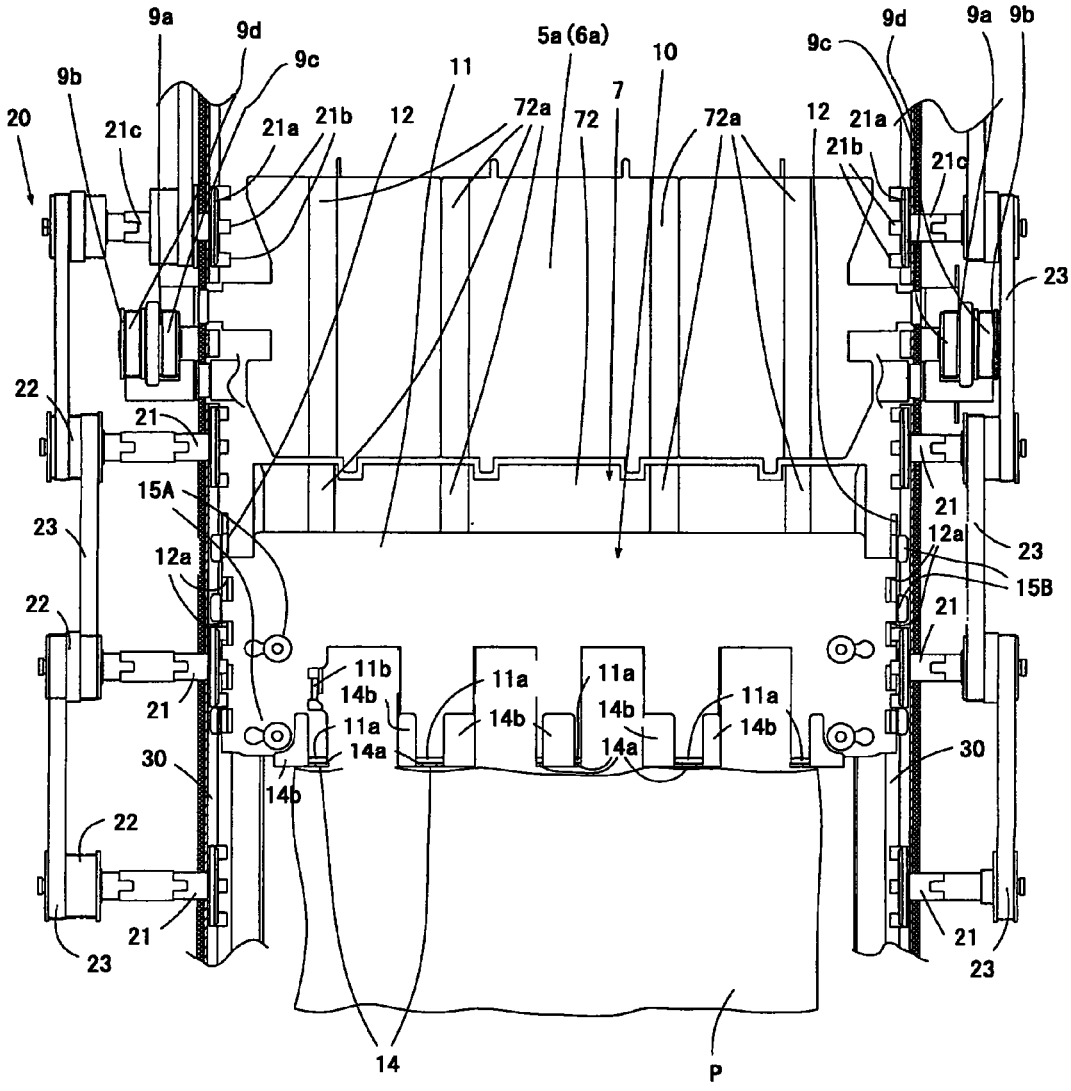
FIG. 2 is a plain view of the above noted bundle transport apparatus.
Figure 3:
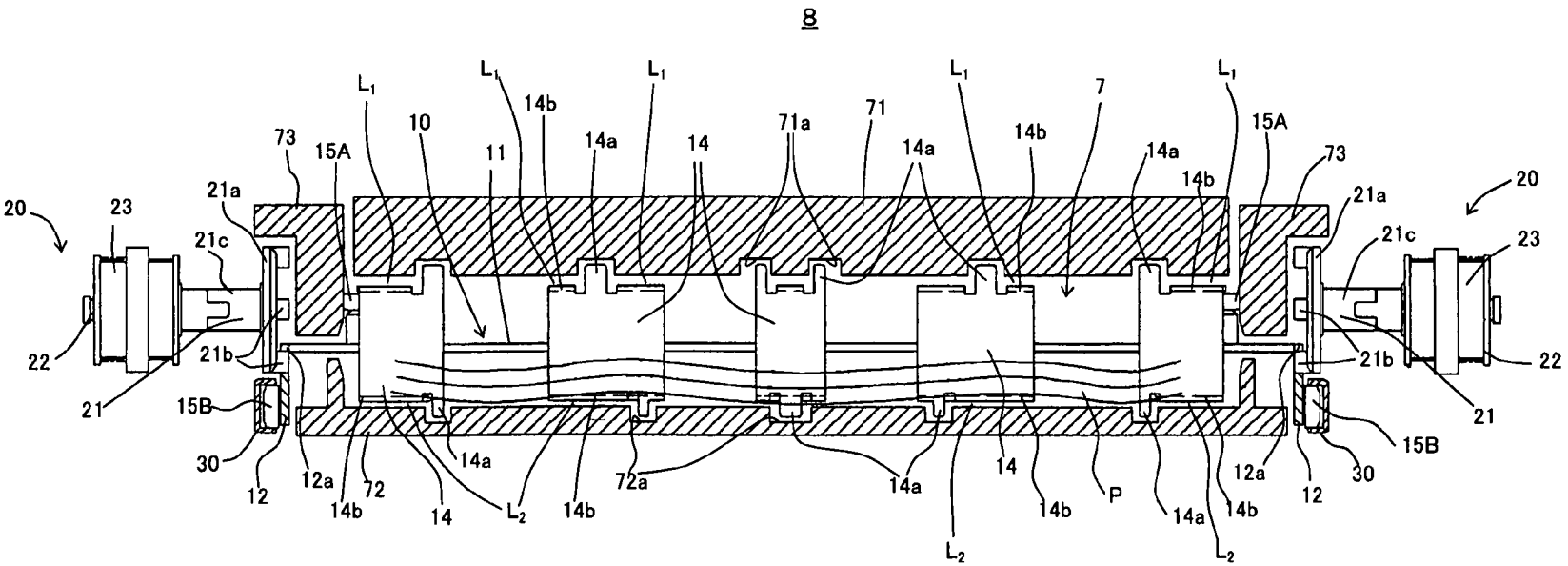
FIG. 3 is a front view of the above noted bundle transport apparatus.
Figure 4A:
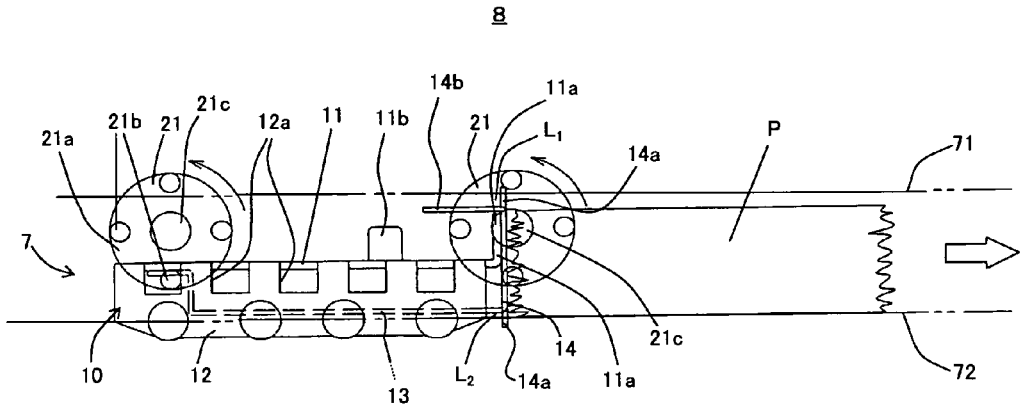
FIG. 4A is a side view showing a transport operation of the above noted bundle transport apparatus.
Figure 4B:
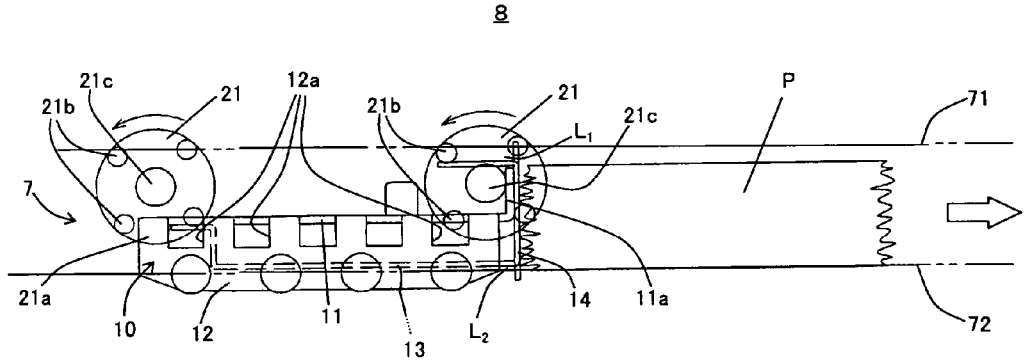
FIG. 4B is a side view showing a transport operation of the above noted bundle transport apparatus.
Figure 4C:
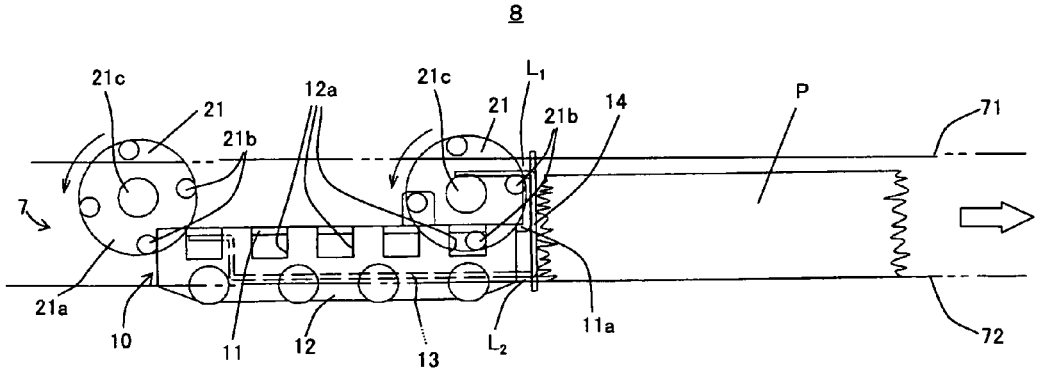
FIG. 4C is a side view showing a transport operation of the above noted bundle transport apparatus.
Figure 5:
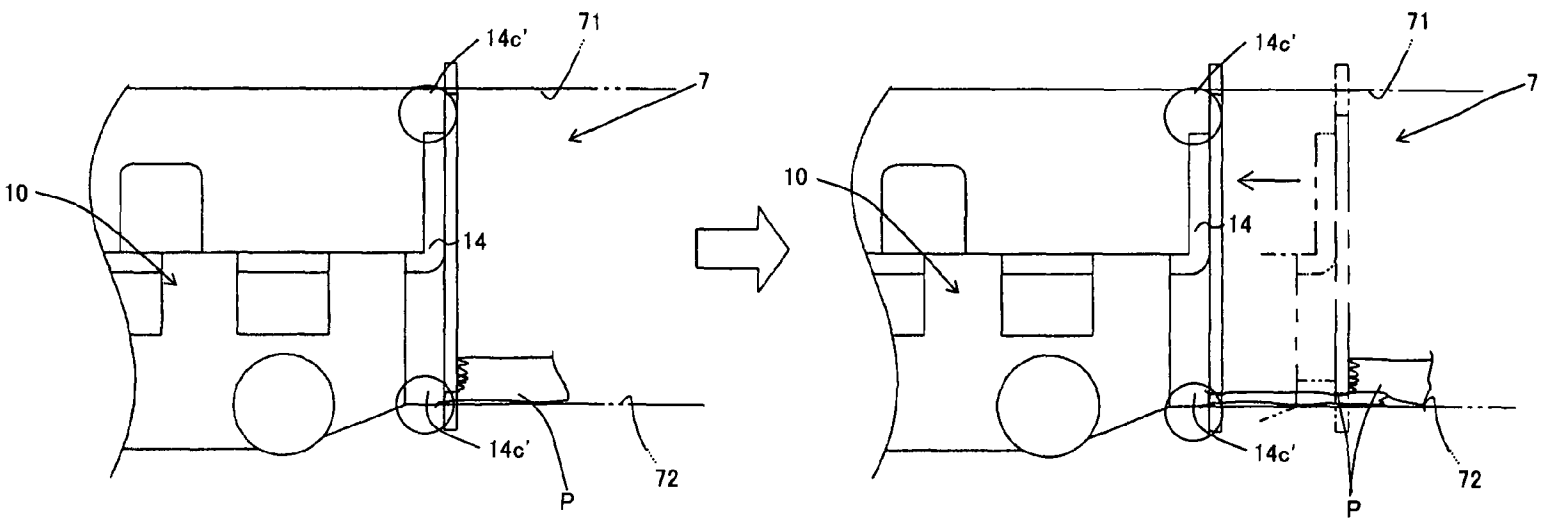
FIG. 5 is a partially enlarged side view showing a transport operation of a comparison example of the above noted bundle transport apparatus.
Figure 6:
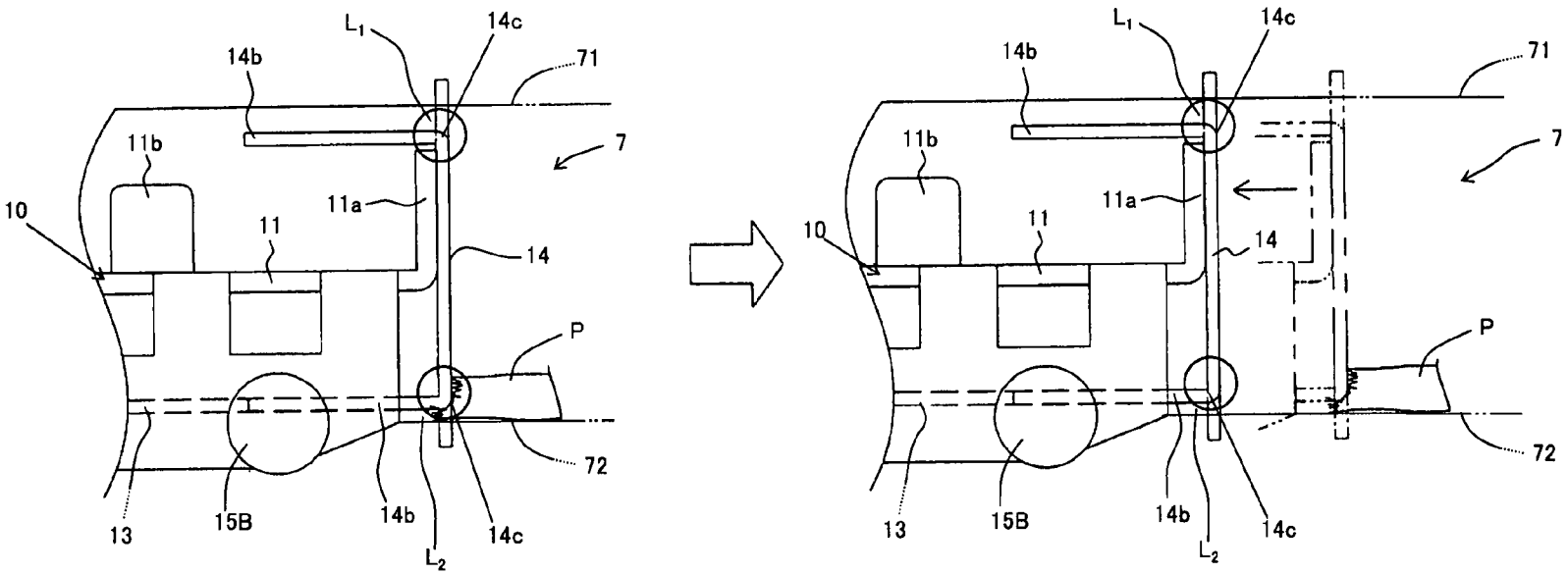
FIG. 6 is a partially enlarged side view showing a transport operation of the above noted bundle transport apparatus.

FIG. 1 is an illustrated diagram showing a paper sheet material handling apparatus (i.e., a banknote receipt and payout apparatus) according to an embodiment of the present invention, and a bundled-paper sheet material transport apparatus constituting a part thereof according to an embodiment of the present invention; FIG. 2 is a plain view of the above noted bundle transport apparatus; FIG. 3 is a front view of the above noted bundle transport apparatus; FIGS. 4A, 4B and 4C are side views respectively showing a transport operation of the above noted bundle transport apparatus; FIG. 5 is a partially enlarged side view showing the transport operation of a comparison example of the above noted bundle transport apparatus; and FIG. 6 is a partially enlarged side view showing the transport operation of the above noted bundle transport apparatus.

Referring to FIG. 1, the numerical 1 is a banknote receipt and payout apparatus which comprises a receipt and payout unit 2 for transporting a bundle of banknotes P in and out of the aforementioned apparatus, a payout unit 3 for transporting a deposited bundle of bank notes P downward on an elevator stage (i.e., an elevator member) 3*a* and paying out separately sheet by sheet, a judgment unit 4 for judging a normality or abnormality of a banknote P by an image sensor, a temporary hold unit 5 for a banknote P judged as normal being fed in, a reject space 6 for a banknote P judged as abnormal being fed in, elevator stages (i.e., elevator mambers) 5*a* and 6*a* for transporting the banknotes P accumulated in the temporary hold unit 5 and reject space 6 upward to a bundle transport path 7 and a bundle transport apparatus 8 for ejeting and transporting the banknotes P transported to the bundle transport path 7 in an actual bundled state.

Referring to FIGS. 2 through 4, the bundle transport path 7 comprises a mutually independent top wall 71 and floor wall 72, and a left and right side walls 73 and 73. The bundle transport apparatus 8, according to the present embodiment, comprises a carrier 10 capable of traveling in the front and back directions within the bundle transport path 7 and a drive force transmission unit 20 for transmitting a drive force to the carrier 10.

The carrier 10, being formed by bending sheet metal which is punched in a predetermined form, comprises a pectinate top panel 11 having continuous projections towards the front and cutouts towards the back, side plates 12 and 12 which are on both sides of the pectinate top panel 11 respectively bent downward, five reed-shaped bottom plates 13, 13, 13, 13 and 13 which are formed by bending back from the rear bottom face of the pectinate top panel 11 toward the front and five ejection plates 14, 14, 14, 14 and 14 that are formed by bending the edges of the respective reed-shaped bottom plates 13 perpendicularly upright.

The carrier 10, in more detail, has five support tabs 11*a*, 11*a*, 11*a*, 11*a* and 11*a* that are formed by bending the edges of the respective projections of the front side of the pectinate top panel 11 perpendicularly upright (refer to FIG. 2, and FIGS. 4A, 4B and 4C), thereby reinforcing each ejection plate 14 from the back.

A flag 11*b* is formed on the carrier 10 by bending a small rectangular tab upright on the front left side of the pectinate top panel 11 for use in an operation control of the carrier 10 traveling on the bundle transport path 7 by an optical sensor (not shown herein) sensing the flag 11*b*.

Furthermore, the system comprises two each of the left & right side support rollers 15A and 15A that are horizontally installed on the vertically fixed rotation shafts 15C and 15C respectively on both the left and right sides of the pectinate top panel 11. These left & right side support rollers 15A support the carrier 10 in the left and right directions by contacting with the left and right side walls 73 and 73 of the bundle transport path 7, thereby allowing the carrier 10 to slide smoothly by preventing a jerking movement.

Five rectangular cutout parts 12*a*, 12*a*, 12*a*, 12*a* and 12*a* with the upper parts opening are featured in a predetermined interval on the upper edge of the left and right side plates 12. Four up and down directions support rollers 15B, 15B, 15B and 15B, for each side are equipped by vertically mounting onto horizontal rotation shafts, respectively, close to the respective lower edges of the both side plates 12. These up and down direction support rollers 15B, being allowed to travel along two rails 30 and 30 that are equipped in parallel with, and on the outside of, the bundle transport path 7 on both sides, and of which cross sectional areas are shaped as a rectangle with either the left or right sides open, support the carrier 10 in the up and down directions to allow it to slide smoothly and thereby preventing a jerking movement.

The present embodiment is configured to further support the carrier 10 in the up and down directions with the up and down directions support rollers 15B by forming predetermined upward and downward gaps $L_1$ and $L_2$ between the respective ejection plates 14, and the top wall 71 and floor wall 72 of the bundle transport path 7, respectively. The upward and downward gaps $L_1$ and $L_2$ are for preventing banknotes P from being hitched by the upper and/or lower edge of each ejection plate 14, and therefore it is desirable to make them large within a range that does not harm the performance of each ejection plate 14 ejecting the banknote P.

The ejection plates 14 are rectangular plate bodies with different widths, and one or two upright tabs 14*a* and 14*a*, and so on, are formed upright toward the top wall 71 and floor wall 72 of the bundle transport path 7 on the top and bottom edges, respectively. These upright tabs 14*a* are accommodated by accommodating grooves 71*a* and 72*a* which are formed in the front and back directions of the top wall 71 and floor walls 72 of the bundle transport path 7 so as to prevent a banknote P from going into the upward and downward gaps $L_1$ and $L_2$ between each ejection plate 14 and the top wall 71 and floor wall 72 of the bundle transport path 7.

A bent back tab 14*b* is formed by bending back the upper and lower parts of each ejection plate 14 toward the back, and then the upper and lower edges of these ejection plates 14 are featured as circular arc surface 14*c*, 14*c*, and so on (refer to FIG. 6). These circular arc surfaces 14*c* are for preventing the banknote P from being hitched by the upper and lower edges of the ejection plates 14, together with the upward and downward gaps $L_1$ and $L_2$ of each ejection plate 14.

Additionally, a drive force transmission unit 20 for transmitting a drive force to the above configured carrier 10 comprises a plurality of drive rollers 21, 21 and so on; of pulleys 22, 22 and so on; and of timing belts 23, 23 and so on.

Each drive roller 21 is rotationally mounted at a predetermined interval onto the left and right side walls (not shown herein) that are equipped on the outside of the bundle transport path 7 with a circular plate 21*a* being projectionally equipped with four bosses 21*b*, 21*b*, 21*b* and 21*b* at the same interval and radially along the circumference of the circular plate 21*a* and with the center and back sides thereof being equipped with a rotation shaft 21*c*.

A pulley 22 is fixed onto the rotation shaft 21*c* of each drive roller 21, and the respective pulleys 22 of the adjacent drive rollers 21 are interconnected by independent timing belts 23, thereby connecting all the drive rollers 21. Note that a pair of the drive rollers 21 on the left and right sidesand located at the endof the bundle transport path 7, are configured to synchronously rotate by receiving a drive force from a single drive source which is not shown herein.

Here, the present embodiment is configured to enable a mutual handover of paper sheet materials P between elevator stages 3*a*, 5*a* and 6*a* and the carrier 10 by making the elevation track of the elevator stages 3*a*, 5*a* and 6*a* cross with the travel track of the carrier 10 comprised by the bundle transport apparatus 8 at the positions Q and R as shown by FIG. 1.

The comprisal of the drive system of the elevator stage 5*a* (also 6*a*) and carrier 10 at the position R is described in detail below. Pulleys 9*a* and 9*a* (also 9*b* and 9*b*) are respectively mounted on the left and right sides of the elevator stage 5*a* (also 6*a*), making the elevator stage 5*a* (also 6*a*) move up and down by transmitting a drive force by timing belts 9*c* and 9*c* (also 9*d* and 9*d*) which are vertically wrapped around the respective pulleys 9*a* (also 9*b*, as shown by FIG. 2. With respect to the above comprisal, the carrier 10 avoids interfering with the pulley 9*a* (also 9*b*) by making the rotation shafts of the above described pulleys 22 longer than the aforementioned pulley 9*a* (also 9*b*).

The above described bundle transport apparatus and handling apparatus for paper sheet materials of the present embodiment are configured to allow the bosses 21*b* of each drive roller 21, which rotates by receiving a drive force from the drive source, engage with the respective cutout parts 12*a* of the carrier 10 sequentially, thereby transmitting the drive force to make the carrier 10 travel in the front and back directions on the bundle transport path 7, as shown by FIGS. 4A, 4B and 4C. This enables each ejection plate 14 of the carrier 10 to eject and transport the banknotes P in the actual bundled state.

Securing an adequately large gap between each cutout part 12*a* of the carrier 10 and the bosses 21*b* of each drive roller 21 makes it possible to have the bosses 21*b* firmly engage with the respective cutout parts 12*a* and absorb a phase difference by the aforementioned gap even if the phase difference is generated by the rotations of the left and right drive rollers 21, thereby accomplishing a stable bundle transport by securely preventing a malfunction of the apparatus.

Additionally, this configuration allows the carrier 10, which is free in the front and back directions in the bundle transport path 7, to travel by transmitting the drive force of each drive roller 21. This eliminates a need to make a flat belt traverse on the bundle transport path 7 as in the case of the conventional belt transport mechanism, and thus makesit possible to equip the system with another belt or transport mechanism, for example, a belt transport mechanism for elevating the elevator stages 3*a*, 5*a* and 6*a* shown by FIG. 1, crossed with the bundle transport path 7 that is the travel track of the carrier 10. As such, the bundle transport apparatus 8 according to the present embodiment has a wide range of versatility without being influenced by other transport mechanisms.

Furthermore, since the carrier 10 is allowed to travel in the front and back directions only if the bosses 21*b* of the drive roller 21 engage with the cutout parts 12 of the carrier 10, it is possible to devise a measure for avoiding the drive system of the elevator stages 3*a*, 5*a* and 6*a* at the intersecting positions Q and R by having long distances of respective pulleys 22, and therefore, passages of the elevator stages 3*a*, 5*a* and 6*a* of the carrier 10 will not cause a problem.

Furthermore, connecting the respective pulleys 22 of the adjacent drive rollers 21, by respectively different timing belts 23, thus connecting all the drive rollers 21, makes it possible to transport with a stable drive force even if the bundle transport path 7 is long, and eliminates the necessity of equipping a large number of components such as rollers, shafts, et cetera, for providing tensions to flat belts, and therefore reduces components and installation space.

Addidionally, equipping the upright tabs 14*a* for each ejection plate 14 of the carrier 10 and forming the accommodating grooves 71*a* and 72*a* for each upright tab 14*a* in the top wall 71 and floor wall 72 of the bundle transport path 7 makes it possible to prevent the banknote P from going into the upward and downward gaps $L_1$ and $L_2$ between each ejection plate 14 and the top wall 71 and floor wall 72 of the bundle transport path 7. Thus contributing to a stable bundle transport by preventing a malfunction such as a paper jam.

In the case of leaving the upper and lower edges of each ejection plate 14 of the carrier 10 as edge 14*c*' untreated, and not considering the upward and downward gaps between each ejection plate 14 and the top wall 71 and floor wall 72 of the bundle transport path 7, the banknote P may be hitched by the unintended narrow upward and downward gaps formed between the edge 14*c*' of each ejection plate 14 and the top wall 71 and floor wall 72 of the bundle transport path 7 as shown by FIG. 5, resulting in causing a mistaken payout if the carrier 10 retracts as the banknote P being hitched.

On the contrary, the present embodiment is configured to make the upper and lower edges of each ejection plate 14 of the carrier 10 a circular arc surface 14*c* and positively form the predetermined upward and downward gaps $L_1$ and $L_2$ between these circular arc surface 14*c* and the top wall 71 and floor wall 72 of the bundle transport path 7 as shown by FIG. 6, thereby providing a benefit of a hitched banknote P coming free smoothly when the carrier 10 retracts if the banknote P goes into the upward and downward gaps $L_1$ and $L_2$. This prevent the banknote P from being hitched by the upper and lower edges of each ejection plate 14, thus contributing to a more stable bundle transport by securely preventing a malfunction such as a paper jam, together with the upright tabs 14*a*.

Note that the bundled-paper sheet material transport apparatus, according to the present invention, is not limited by the above described embodiment. For example, the above described embodiment is configured to transport the banknote P in a bundle by equipping the present bundle transport apparatus 8 as a part of the banknote receipt and payout apparatus 1 such as an ATM. The present invention, however, can be used widely for a skew correction for paper sheet materials relating to pass books, tickets, gift cirtificates, cheques, cards, securities, bonds, et cetera, instead of being limited to the above described embodiment.

What is claimed is:

1. A bundled-paper sheet material transport apparatus comprising:

a carrier, being capable of traveling back and forth on a bundled-paper sheet material transport path, equipped with an ejection plate on the front for ejecting the bundled-paper sheet material and equipped with a plurality of cutout parts, which are open in their top and side parts, at a predetermined interval on its both left and right sides;

a drive transmission unit equipped with a plurality of drive rollers, each of which comprises a plurality of bosses in a predetermined interval on a single circumference around the rotation center thereof, in a predetermined interval on the both left and right sides of the bundled-paper sheet material transport path;

each drive roller having a pulley thereon;

a plurality of timing belts mutually shared by the respective pulleys of the adjacent drive rollers thereon, wherein the pulley is connected with the pulleys of the adjacent drive rollers by respective timing belts;

left and right side support rollers horizontally installed on vertically fixed rotation shafts respectively on both left and right sides of a top panel of the carrier;

two rails equipped in parallel with, and on the outside of, the bundled-paper sheet material transport path on both sides, and of which cross sectional areas are shaped as a rectangle opening to the carrier;

up and down directions support rollers, being allowed to travel along the two rails, and for each side are equipped by vertically mounting onto horizontal rotation shafts, respectively, being close to the respective lower edges of both side plates of the carrier; and pulleys around which timing belts are vertically wrapped, the timing belts transmitting a drive force that makes an elevator stage move upward or downward, the elevator stage transporting a bundle of paper sheet materials upward or downward, wherein, a drive force is transmitted by allowing bosses of each drive roller, which rotates by receiving a drive force from a drive source, engage in respective cutout parts of the carrier sequentially, thereby allowing the carrier to travel in the front and back directions of the bundled-paper sheet material transport path;

each cutout part is a rectangular parallelepiped;

each boss is a circular cylinder;

the width of each cutout part is larger than the circular diameter of each boss in the direction of the bundled-paper sheet material transport path so as to provide a gap between each cutout part and each boss in the direction of the bundled-paper sheet material transport; and rotation shafts of the pulleys of the drive rollers are longer than the pulleys of the elevator stage.

2. The bundled-paper sheet material transport apparatus according to claim 1, further comprising:

one or more tabs formed on the ejection plate toward a top wall and/or a floor wall of the bundle transport path, and one or more grooves formed on the top wall and/or the floor wall along the bundle transport path in order to accommodate the tabs.

3. The bundled-paper sheet material transport apparatus according to claim 2, wherein upper and/or lower parts of the ejection plate are/is bent back toward the back direction of the bundle transport path into a circular arc shape, and a predetermined gap is provided between the upper and/or lower edges of the ejection plate and the top and/or floor walls of the bundle transport path.

4. A paper sheet material handling apparatus comprising:

a bundled-paper sheet material transport apparatus according to claim 2; and an elevator member for transporting a bundle of paper sheet materials upward or downward, wherein a handover of the paper sheet materials mutually between the carrier of the bundle transport apparatus and the elevator member is enabled by making the elevation track of the elevator member cross with the travel track of the carrier of the bundle transport apparatus.

5. The bundled-paper sheet material transport apparatus according to claim 1, wherein upper and/or lower parts of the ejection plate is/are bent back toward the back direction, of the bundle transport path into a circular arc shape, and a predetermined gap is provided between the upper and/or lower edges of the ejection plate and the top and/or floor walls of the bundle transport path.

6. A paper sheet material handling apparatus comprising:

a bundled-paper sheet material transport apparatus according to claim 1; and an elevator member for transporting a bundle of paper sheet materials upward or downward, wherein a handover of the paper sheet materials mutually between the carrier of the bundle transport apparatus and the elevator member is enabled by making the elevation track of the elevator member cross with the travel track of the carrier of the bundle transport apparatus.

* * * * *